US005197449A

United States Patent [19]

Okamoto et al.

[11] Patent Number: 5,197,449

[45] Date of Patent: Mar. 30, 1993

[54] IGNITION SYSTEM FOR AN ENGINE

[75] Inventors: Yoshiyuki Okamoto; Nobuyuki Oota, both of Kariya, Japan

[73] Assignee: Aisin Seiki Kabushiki Kaisha, Kariya, Japan

[21] Appl. No.: 846,944

[22] Filed: Mar. 6, 1992

[30] Foreign Application Priority Data

Mar. 6, 1991 [JP] Japan ..... 3-63686

[51] Int. Cl.[5] ..... F02P 3/04

[52] U.S. Cl. ..... 123/622; 123/644

[58] Field of Search ..... 123/606, 620, 622, 636, 123/637, 640, 644, 655

[56] References Cited

U.S. PATENT DOCUMENTS

| | | | |
|---|---|---|---|
| 1,428,635 | 9/1922 | Hunt | 123/622 |
| 4,327,310 | 4/1982 | Jörg | 123/644 |
| 4,356,807 | 11/1982 | Tokura et al. | 123/644 |
| 4,361,129 | 11/1982 | Sugie et al. | 123/622 |
| 4,378,779 | 4/1983 | Hachiga et al. | 123/644 |
| 4,493,306 | 1/1985 | Asik | 123/622 |
| 4,986,233 | 1/1991 | Akagi et al. | 123/634 |
| 5,097,815 | 3/1992 | Oota et al. | 123/644 |
| 5,140,970 | 8/1992 | Akaki et al. | 123/644 |

FOREIGN PATENT DOCUMENTS 1-116281 5/1989 Japan .

*Primary Examiner*—Willis R. Wolfe

*Attorney, Agent, or Firm*—Oblon, Spivak, McClelland, Maier & Neustadt

[57] ABSTRACT

An ignition system has a plurality of primary and secondary coils, ignition timing means for providing an ignition timing signal and current supply means for supplying a current to the primary coils in response to an ignition timing signal. A current is supplied to a plurality of the primary coils at the same time to charge the coils so that a charge time is shortened.

2 Claims, 2 Drawing Sheets

IGNITION SYSTEM FOR AN ENGINE

BACKGROUND OF THE INVENTION

1. Field of the Invention

The present invention relates to an ignition system for an automobile engine.

2. Description of the Prior Art

A conventional multi-ignition system supplies ignition currents to the ignition plug many times in response to an ignition timing signal. This prevents the ignition from misfire. This kind of multi-ignition system uses an ignition coil. In order to obtain a high ignition energy, a time to charge the primary winding of the coil requires a fairly long period of time. Spark break which is a time period between two sparks becomes longer because of a longer charging time of the ignition coil. Spark break can be reduced by using an ignition coil with a less inductance. This, however, reduces the ignition energy of the spark. Japanese Patent Laid Open Hei 1-16281 (1989) shows an ignition system using a DC-DC converter. A DC-DC converter converts a power voltage into a higher voltage to charge the primary coil quickly. A DC-DC converter, however, makes a system fairly big and a higher voltage applied to the primary coil may make a secondary coil's life shorten.

SUMMARY OF THE INVENTION

Accordingly, one of the objects of the present invention is to produce an ignition system to obviate the above drawbacks.

Another object of the present invention is to produce an ignition system which can obtain a high ignition energy without using a DC-DC converter.

To achieve the above objects, and in accordance with the principles of the invention as embodied and broadly described herein, an ignition system for an automobile comprises coil means has a plurality of primary and secondary coils, ignition timing means for providing an ignition timing signal, current supply means for supplying a current to the primary coils in response to an ignition timing signal and current detecting means for detecting said current level for switching said current supply means off when said current level is higher than a predetermined level.

In accordance with the above mentioned ignition system, the system charges the primary coils when the current supply means supplies the current to the primary coils. When the current is cut off by the current detecting means, the secondary coils generate inductive current to spark an ignition. Because the coils comprise of a plurality of primary and secondary coils, a charging time is shorter than a time to charge one primary coil which has the same inductance.

BRIEF DESCRIPTION OF THE DRAWING

For a full understanding of the true scope of the invention, the following detailed description should be read in conjunction with the drawing, wherein.

DETAILED DESCRIPTION OF THE PREFERRED EMBODIMENTS

In the following, preferred embodiments of the present invention will be described with reference to the drawings.

Figure 1:
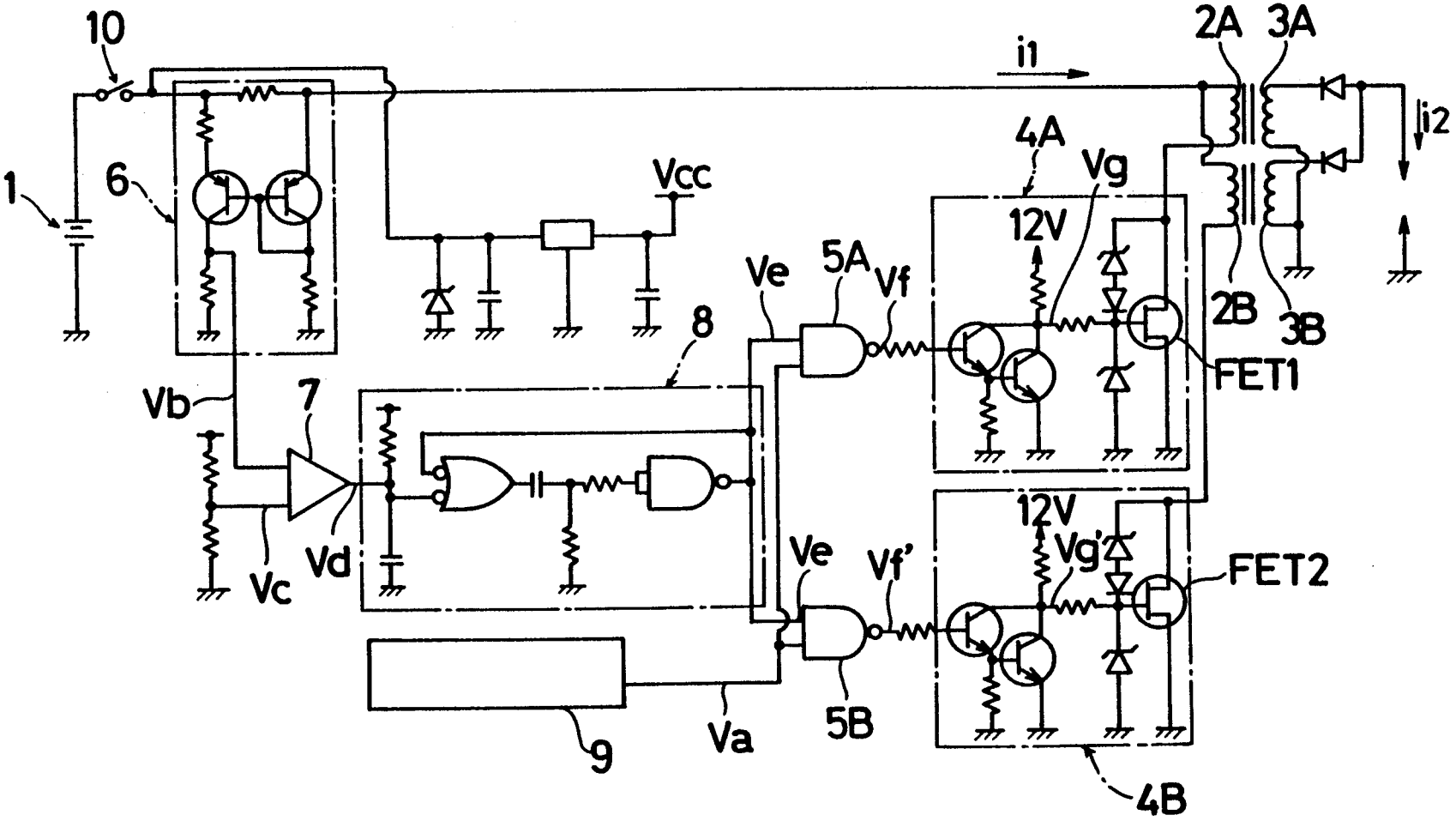
FIG. 1 is a diagram which shows a circuit of an ignition system of the present invention.

FIG. 1 shows a circuit diagram of an ignition system of the present invention.

Referring to FIG. 1, a power source 1 supplies a voltage (12 V) to a primary coil. The primary coil consists of the first primary coil 2A and the second primary coil 2B. A total of the turns of the first primary coil 2A and the second primary coil 2B is the turns of the primary coil of the circuit. The secondary coil consists of the first secondary coil 3A and the second secondary coil 3B. The output terminal of the first primary coil 2A is connected to a field effective transistor FET 1 of the first switching circuit 4A. The first switching circuit 4A is connected to the output of the first NAND gate 5A. The output terminal of the second primary coil 2B is connected to a field effective transistor FET 2 of the second switching circuit 4B. The second switching circuit 4B is connected to the output of the second NAND gate 5B. A current detecting circuit 6 such as a current Miller circuit is connected between the power source 1 and the first primary coil 2A. The output of the current detecting circuit 6 is connected to the input terminal of the comparator 7. The comparator 7 is connected to the monostable multivibrator 8. The output of the monostable multivibrator 8 is connected to the input terminals of the first NAND gate 5A and the first NAND gate 5B. The ignition timing signal generator 9 is connected to the other terminals of the first NAND gate 5A and the first NAND gate 5B.

Figure 2:
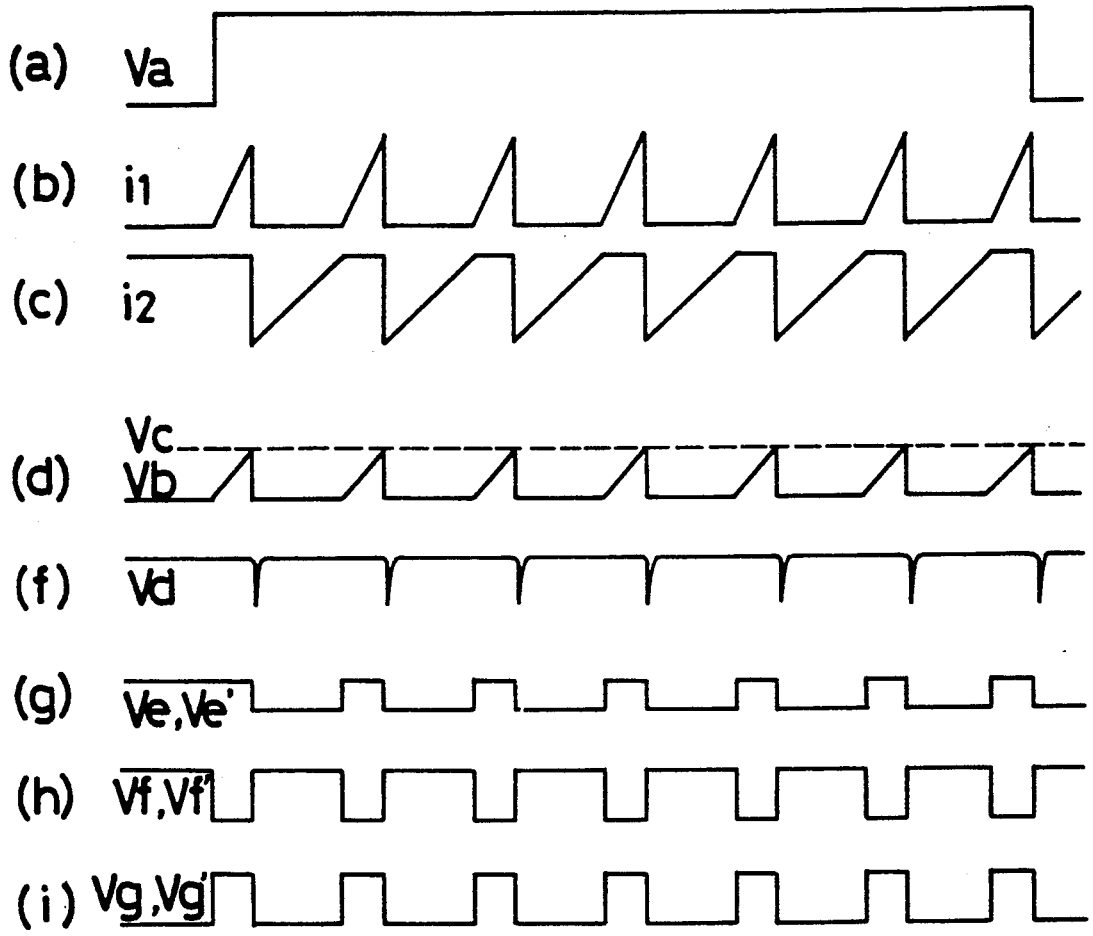
FIG. 2 is a timing chart which shows signals of the circuit of the present invention.

FIG. 2 is a time chart shows an operation of the ignition system of the invention.

The monostable multivibrator 8 outputs high (H) signals Ve and Ve' to the first and second NAND gates 5A and 5B, respectively, as shown in FIG. 2, (g). When the ignition timing signal generator 9 sends an ignition timing signal Va to the first and second NAND gates 5A and 5B as shown in FIG. 2, (a), the output signals Vf and Vf' of the first and second NAND gates 5A and 5B are turned into low (L) signals as shown in FIG. 2, (h). The first and second switching circuits 4A and 4B turn the output signals Vg and Vg' on to high (H) as shown in FIG. 2, (i). Then the current $i_1$ is supplied to the first and second primary coils 2A and 2B to start charging the coils 2A and 2B as shown in FIG. 2, (b).

The current detecting circuit 6 detects the current $i_1$ and sends a current signal Vb to the opposite phase input terminal of the comparator 7 as shown in FIG. 2, (d). A predetermined voltage signal Vc is input to the other terminal of the comparator 7. When the input current signal Vb becomes greater than the predetermined voltage signal Vc, the comparator switches the output signal Vd into low (L) as shown in FIG. 2, (d) and (f). The monostable multivibrator 8 switches the output signal Ve into low (L) as shown in FIG. 2, (g). The first and second NAND gates 5A and 5B switch the output signals Vf and Vf' into high (H) then the first and second switching circuits 4A and 4B turn off as shown in FIG. 2, (i) in order to cut the current signal $i_1$ off as shown in FIG. 2, (b). Thus the second current $i_2$ generates in the first and second secondary coils 3A and 3B.

When the current iis cut off, the signal Vb of the current detecting circuit 6 goes lower than the predetermined voltage signal Vc. The comparator 7 changes the signal Vd into high (H) to change the output signal Ve of the monostable multivibrator 8 into high (H). The output signals Vf and Vf' of the first and second NAND gates 5A and 5B become high (H) signals to turn the first and second switching circuits 4A and 4B on. The current $i_1$ starts again when the current $i_2$ stops. These steps repeat when the the ignition timing signal Va is high.

Figure 3:
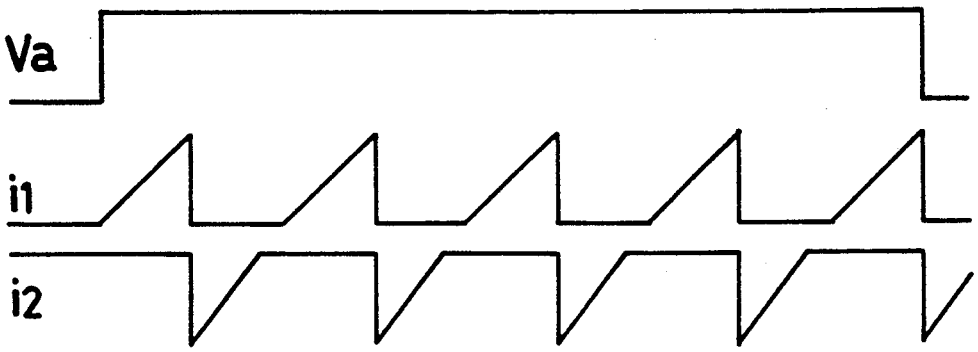
Fig. 3 (PRIOR ART)
FIG. 3 is a timing chart which shows signals of a conventional ignition system.

FIG. 3 shows an operation of a conventional ignition system. As shown in FIG. 3, a charging time is relatively longer than a charging time of the present invention as shown in FIG. 2.

In this embodiment the coils are divided into two coils, however, the coils can be divided into more than three coils. The coils are divided into more coils, a charge time becomes shorter.

The invention has been described in an illustrative manner, and it is to be understood that the terminology which has been used in intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. An ignition system for an automobile comprising:

coil means having a plurality of primary and secondary coils;

ignition timing means for providing an ignition timing signal;

current supply means for supplying a current to said primary coils in response to said ignition timing signal; and current detecting means for detecting said current level for switching said current supply means off when said current level is higher than a predetermined level.

2. Apparatus according to claim 1, wherein said coil means has a pair of primary coils and a pair of secondary coils.

* * * * *